US011805889B1

(12) United States Patent
Martin

(10) Patent No.: US 11,805,889 B1
(45) Date of Patent: Nov. 7, 2023

(54) WEARABLE SUNBLOCK CONTAINER

(71) Applicant: David Edward Martin, London (GB)

(72) Inventor: David Edward Martin, London (GB)

( * ) Notice: Subject to any disclaimer, the term of this patent is extended or adjusted under 35 U.S.C. 154(b) by 0 days.

(21) Appl. No.: 17/949,050

(22) Filed: Sep. 20, 2022

(51) Int. Cl.
*A45D 40/18* (2006.01)
*A45F 5/00* (2006.01)
*A45D 40/22* (2006.01)
*A45D 40/00* (2006.01)

(52) U.S. Cl.
CPC ..... *A45F 5/00* (2013.01); *A45D 40/18* (2013.01); *A45D 40/22* (2013.01); *A45D 2040/0012* (2013.01); *A45F 2005/002* (2013.01); *A45F 2005/008* (2013.01)

(58) Field of Classification Search
CPC .... A45D 40/18; A45D 40/22; A45D 40/0012; A45D 33/006; A45D 40/00; A45D 33/08; A45D 33/33; A45F 2005/002; A45F 2005/008; A45F 2003/006
See application file for complete search history.

(56) References Cited

U.S. PATENT DOCUMENTS 3,212,689 A * 10/1965 Woolfolk ..... F42B 39/02 206/254
5,092,354 A * 3/1992 Pacelli, Jr. ..... A45D 40/22 206/823
6,464,389 B1 * 10/2002 Ghoorahoo ..... G04B 37/127 368/278
7,314,051 B2 * 1/2008 Yuhara ..... A45D 33/006 132/294
7,433,275 B2 * 10/2008 Ellner ..... G04B 37/0427 368/88
8,044,363 B2 * 10/2011 Ales ..... G01J 1/0219 382/116
8,897,100 B2 * 11/2014 Joo ..... G04F 3/06 368/109
10,076,582 B1 * 9/2018 Liao ..... A61L 2/24
10,325,479 B2 6/2019 Fateh et al.
10,463,133 B2 * 11/2019 Sun ..... G01J 1/429
10,814,148 B2 * 10/2020 Poutiatine ..... A61B 5/0077
2005/0022554 A1 * 2/2005 Davidson ..... A44C 17/0208 63/1.14
2008/0251539 A1 10/2008 Yapaola et al.
2017/0172895 A1 * 6/2017 Marigliano ..... A61K 8/31
2022/0000225 A1 * 1/2022 Imbriani ..... A44C 15/002

FOREIGN PATENT DOCUMENTS

CN 202075232 U * 12/2011
CN 109072076 A * 12/2018

* cited by examiner

*Primary Examiner* — Adam J Waggenspack
(74) *Attorney, Agent, or Firm* — Plager Schack LLP; Mark H. Plager; Naomi Mann

(57) ABSTRACT

Disclosed is a wearable sunblock container, comprising a sunblock holder including an interior cavity configured to contain sunblock, and a strap configured to attach the sunblock holder to a user's body. In certain embodiments, the sunblock container is in the form of a wristwatch, wherein the sunblock holder resembles a wristwatch timepiece, and the strap includes a first strap end coupled to a first side of the sunblock holder and a second strap end coupled to a second side of the sunblock holder.

3 Claims, 3 Drawing Sheets

WEARABLE SUNBLOCK CONTAINER

BACKGROUND

The present disclosure relates generally to UV protection systems and more particularly to devices for containing sunblock/sunscreen.

Individuals may sometimes forget to apply sunscreen, and/or not have sunscreen readily available when needed. As such, there is a need for an improved system that addresses such limitations.

SUMMARY

According to various embodiments, disclosed is a wearable sunblock container, comprising a sunblock holder including an interior cavity configured to contain sunblock; and a strap configured to attach the sunblock holder to a user's body. In certain embodiments, the sunblock container is in the form of a wristwatch, wherein the sunblock holder resembles a wristwatch timepiece, and the strap includes a first strap end coupled to a first side of the sunblock holder and a second strap end coupled to a second side of the sunblock holder.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
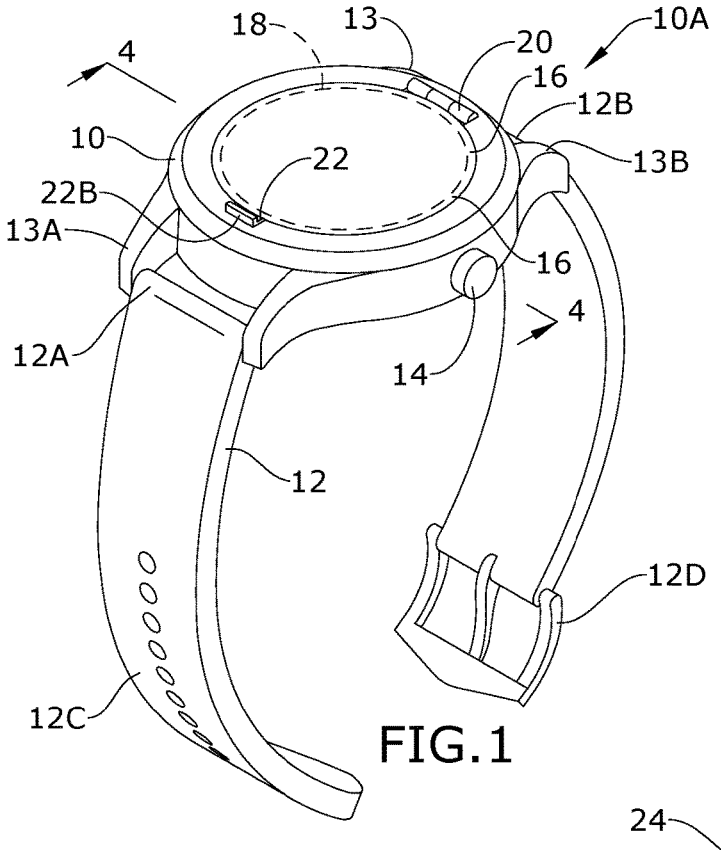
FIG. 1 is a perspective view of a wearable sunblock container having the form of a wristwatch, in accordance with various embodiments.
Figure 2:
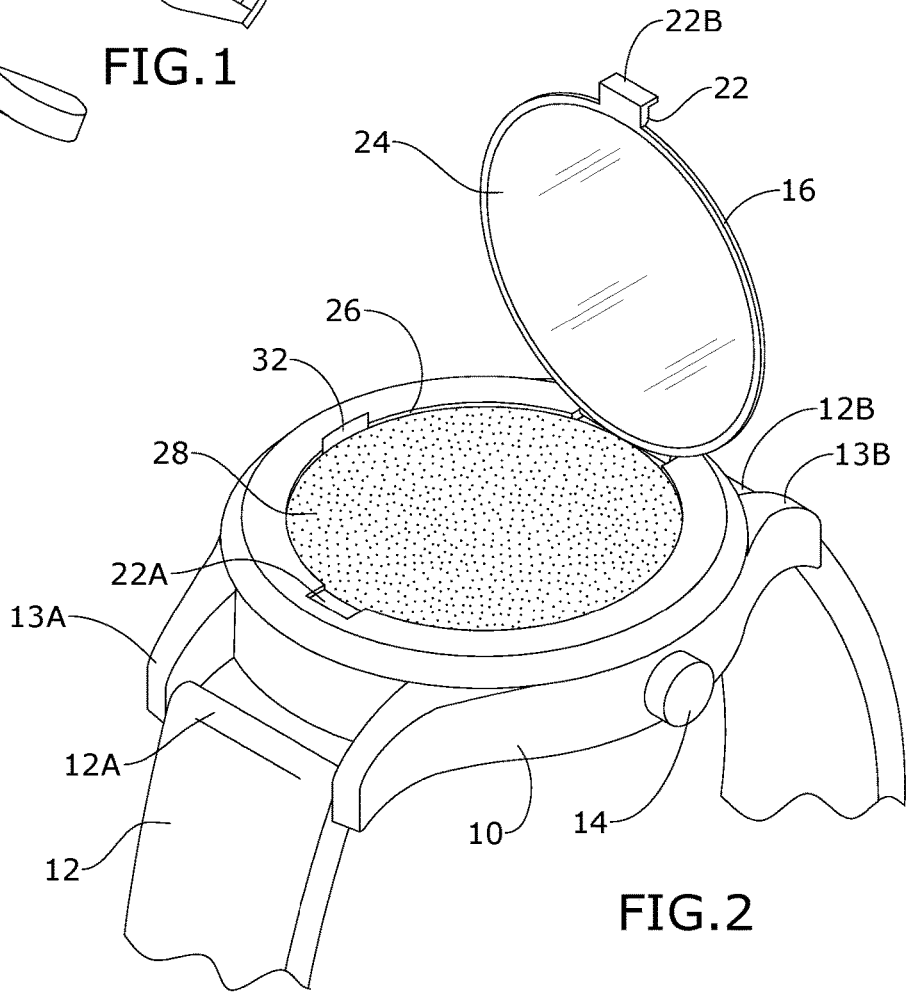
FIG. 2 is a perspective view of the wearable sunblock container, showing a cover of container in an open position.
Figure 3:
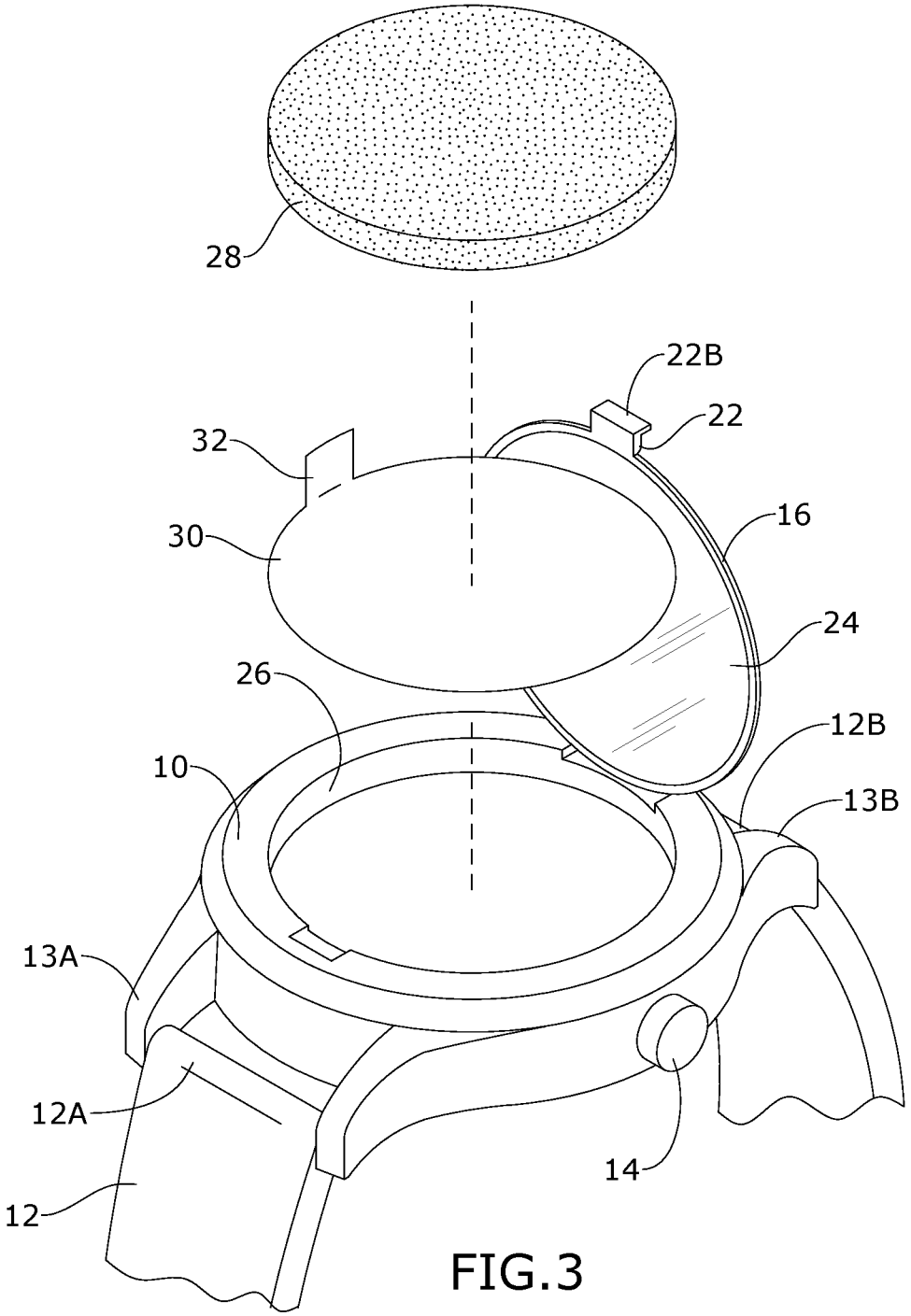
FIG. 3 is an exploded view of the wearable sunblock container.
Figure 4:
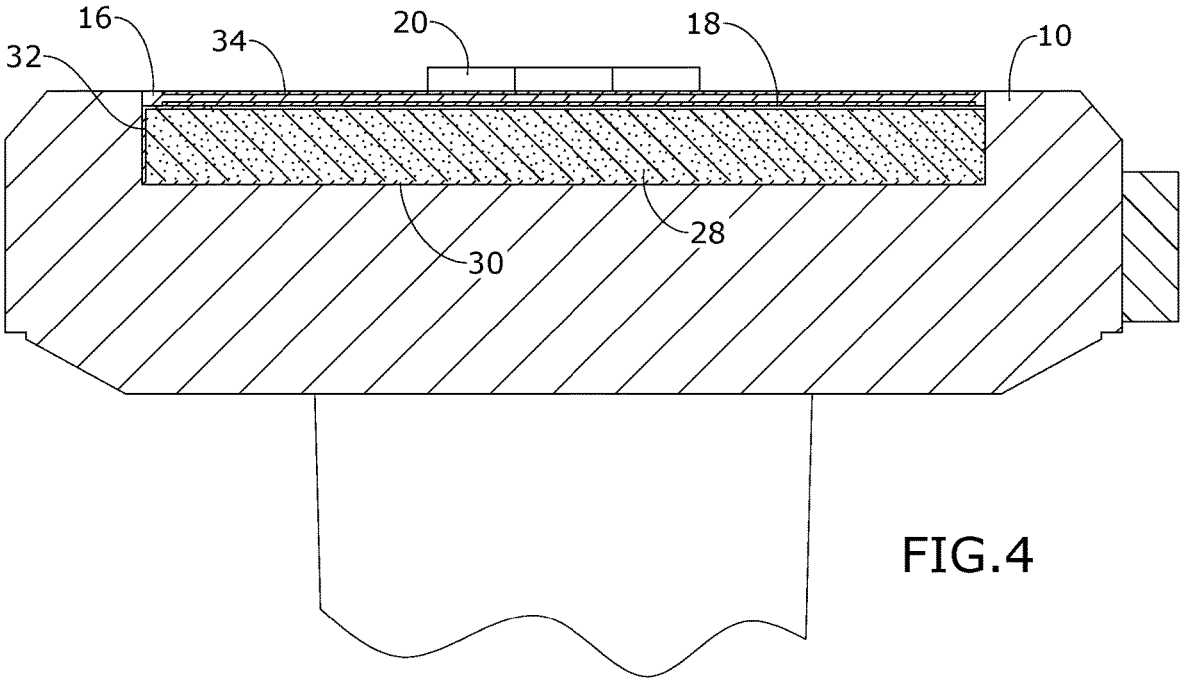
FIG. 4 is a section view of the wearable sunblock container, taken along line 4-4 in FIG. 1
Figure 5:
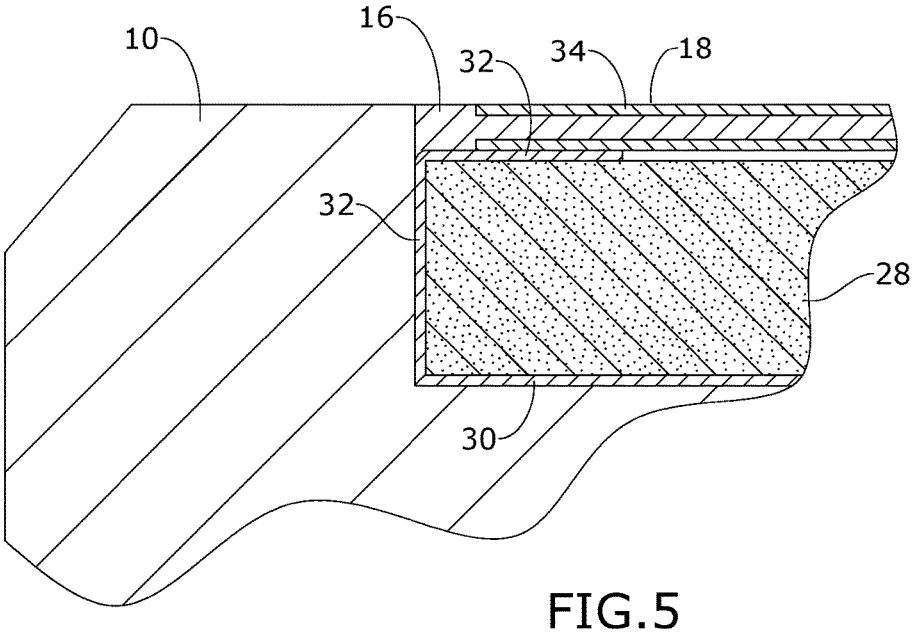
FIG. 5 is a detailed section view of the wearable sunblock container.

According to various embodiments as depicted in FIGS. 1-5, disclosed is a UV protection system comprising a wearable sunblock container 10, comprising a sunblock holder 13 configured to contain a sun protective composition 28 such as sunblock, sunscreen, and the like (referred to herein as "sunblock 28"). In certain embodiments, sunblock 28 may be a solid sunblock. In some embodiments, the disclosed system may provide for refills of sunblock 28 ("solid sunblock 28"). In other embodiments, wearable sunblock container 10 may be provided as a disposable, single use product. In some embodiments, wearable sunblock container 10 may comprise a UV sensor and indicator.

In certain embodiments, wearable sunblock container 10 may have the form and appearance of a wristwatch 10A and is configured to be worn around a user's wrist. To this end, wearable sunblock container 10 may comprise a wrist strap 12 coupled to sunblock holder 13. In further embodiments, sunblock holder 13 may further comprise a button 14 resembling a watch crown. As such, sunblock holder 13 may resemble a conventional wristwatch timepiece.

In certain embodiments, wrist strap 12 may comprise first strap end 12A and a second strap end 12B coupled to sunblock holder 13 at opposite sides 13A and 13B of sunblock holder 13, respectively. In one embodiment as depicted in FIG. 1, wrist strap 12 may be an adjustable buckle strap, comprising a first strap half with notches 12C and a second strap half with a buckle 12D. In further embodiments, first and second strap ends 12A, 12B, may be coupled to sunblock holder via lugs provided at sides 13A and 13B of sunblock holder 13. It shall be appreciated however, that different strap designs including attachment configurations may be employed in alternate embodiments. For example, a single piece strap which may be stretchable may be used instead of a two-piece strap in some embodiments. Additionally, while sunblock holder 13 is depicted as a circular piece, different geometric configurations and designs may be provided in alternate embodiments.

In certain embodiments, sunblock holder 13 may comprise an interior cavity 26 configured to hold solid sunblock 28. In further embodiments, sunblock holder 13 may comprise a cover 16 configured to open and close interior cavity 26. In one embodiment, cover 16 may be rotationally coupled to interior cavity 26 via a hinge 20 attached at corresponding rim section of the cavity and cover. In further embodiments, cover 16 may be configured to securely close over interior cavity 26 via a locking mechanism. In some embodiments, the locking mechanism may comprise a latch 22 comprising a latch release component 22B provided on the rim of cover 16. Latch 22 may be configured to engage within a recess 22A provided within the rim of interior cavity 26, and to disengage by pushing against latch release component 22B with the user's finger. In some embodiments, latch 22 and recess 22A may include magnetic components for a magnetic attachment in the closed position. It shall be appreciated that various lock and release mechanisms may be provided in alternate embodiments. For example, button 14 resembling the watch crown may be configured as a release button which causes cover to open upon pressing button 14 in alternate embodiments. In certain embodiments, a mirror 24 may be provided on an interior surface of cover 16. As such, cover 16 protectively preserves sunblock 28 within interior cavity 26, and may be opened to expose sunblock 28 and mirror 24 such that a user may view him/herself when applying sunblock 28.

In certain embodiments, sunblock 28 may be provided in a solid cake form, which prevents spilling as opposed to a liquid sunblock. In certain embodiments, a liner 30, which may be a paper sheet, may be disposed beneath solid sunblock 28. Liner 30 may include a tab 32 which sticks out from solid sunblock 28, such that a user may pull up tab 32 to remove and replace sunblock 28 with a new refill. It shall be appreciated however, that liquid sunblock may be used in alternate embodiments. In certain embodiments, wearable sunblock container 10 may be provided as a disposable single use sunblock container which may be thrown away after the sunblock has been used up.

In certain embodiments, wearable sunblock container 10 may comprise a UV sensor 34 configured to sense and display the level of UV radiation. In one embodiment, UV sensor 34 may comprise a UV sensitive plastic, which may be provided on a front side 18 of cover 16 opposite mirror 24. As such, the UV level may be automatically displayed on wearable sunblock container 10. It shall be appreciated that various parts of wearable sunblock container 10 including strap 12 may be made of UV sensitive plastic in alternate embodiments.

The disclosed subject matter provides a system which enables an individual to conveniently carry sunblock and may further encourage and/or remind the user to apply sunblock. The device may be used by individuals of any age but may be a particle useful tool for educating and encouraging young children to apply sunblock.

It shall be appreciated that the disclosed wearable sunblock container 10 can have multiple configurations in different embodiments. In alternate embodiments, wearable sunblock container 10 may be in the form of a bracelet, anklet, pendant/necklace, armband, belt, or various other accessories worn on the body. It shall be appreciated that the components of wearable sunblock container 10 described herein may comprise any alternative known materials in the field and be of any size and/or dimensions. It shall be appreciated that the components of wearable sunblock container 10 may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A wearable sunblock container, comprising:

a sunblock holder including an interior cavity containing solid sunblock; and at least one strap configured to attach the sunblock holder to a user's body by encircling around the user's wrist, the strap being size adjustable and comprising a first strap half including an end coupled to a first side of the sunblock holder and a second strap half including an end coupled to a second side of the sunblock holder opposite the first side, the first strap half comprising notches and the second strap half comprising a buckle;

wherein the sunblock holder is provided with a cover which is coupled to the sunblock holder via a hinge, and is configured to move between a closed position for enclosing the sunblock contained within the interior cavity, and an open position for exposing the sunblock for user application, wherein the cover has an outer surface comprising a UV sensitive material, the UV sensitive material configured to indicate a level of ambient UV radiation, wherein the sunblock container is in the form of a wristwatch, wherein the cover is configured to releasably lock over the interior cavity via a latch component, and wherein the cover comprises a mirror on an inner side of the cover.

2. The wearable sunblock container of claim 1, further comprising a liner configured to dispose beneath the sunblock, the liner including a tab which is configured to be exposed outside the sunblock and facilitates removal of the sunblock from the interior cavity.

3. The wearable sunblock container of claim 1, the UV sensitive material comprising a UV sensitive plastic.

* * * * *